US011219284B2

(12) United States Patent
LeCompte et al.

(10) Patent No.: US 11,219,284 B2
(45) Date of Patent: Jan. 11, 2022

(54) SNAP BUTTON ASSEMBLY

(71) Applicant: YKK Corporation of America, Marietta, GA (US)

(72) Inventors: Chuck G. LeCompte, Frankfort, KY (US); Jonathan H. Sharp, Lawrenceburg, KY (US); William George Wilson, Lawrenceburg, KY (US)

(73) Assignee: YKK Corporation of America, Marietta, GA (US)

( * ) Notice: Subject to any disclaimer, the term of this patent is extended or adjusted under 35 U.S.C. 154(b) by 0 days.

(21) Appl. No.: 16/843,724

(22) Filed: Apr. 8, 2020

(65) Prior Publication Data

US 2020/0359751 A1 Nov. 19, 2020

Related U.S. Application Data

(60) Provisional application No. 62/849,436, filed on May 17, 2019.

(51) Int. Cl.
*A44B 17/00* (2006.01)

(52) U.S. Cl.
CPC ..... *A44B 17/0076* (2013.01); *A44B 17/0011* (2013.01); *A44B 17/0041* (2013.01)

(58) Field of Classification Search
CPC ..... A44B 17/0011; A44B 17/0041; A44B 17/0076
See application file for complete search history.

(56) References Cited

U.S. PATENT DOCUMENTS 557,704 A * 4/1896 Richardson ..... A44B 17/0052 24/681
1,904,122 A * 4/1933 Chapman ..... A44B 17/0052 24/575.1
2,745,159 A * 5/1956 Jones ..... A44B 17/0029 24/693
2,817,134 A * 12/1957 Fenton ..... F16B 21/06 24/681
4,757,662 A * 7/1988 Gasser ..... B25B 27/0028 24/459
5,647,107 A * 7/1997 Brewster ..... G09F 7/00 24/713.6
D626,451 S * 11/2010 Helwig ..... D11/220
D626,452 S 11/2010 Helwig et al.
8,561,269 B2 10/2013 LeCompte et al.
D695,591 S * 12/2013 Ackerman ..... D8/349
D700,501 S * 3/2014 Ackerman ..... D8/349
8,702,478 B2 * 4/2014 Loveless ..... B24B 55/102 451/453

(Continued)

*Primary Examiner* — David M Upchurch
(74) *Attorney, Agent, or Firm* — Kilpatrick Townsend & Stockton LLP

(57) ABSTRACT

A female snap assembly includes a cage and an engagement member. The cage defines a receiving region, and the engagement member is within the receiving region. The engagement member includes a base, an inner engagement wall extending from base, and an outer engagement wall extending from the base. In some examples, the engagement member defines a channel between the inner engagement wall and the outer engagement wall. In various examples, the inner engagement wall defines at least one notch extending through the inner engagement wall.

19 Claims, 10 Drawing Sheets

(56) References Cited

U.S. PATENT DOCUMENTS

| | | | | |
|---|---|---|---|---|
| 9,845,036 | B2 | 12/2017 | Masanek, Jr. et al. | |
| 10,124,742 | B2 * | 11/2018 | Martinez | B60R 13/011 |
| 10,130,148 | B1 * | 11/2018 | Au | A44B 17/007 |
| D899,967 | S * | 10/2020 | Chan | D11/220 |
| 10,864,836 | B2 * | 12/2020 | Power | B60N 3/046 |
| 2001/0004784 | A1 * | 6/2001 | Calabrese | B60N 3/046 16/8 |
| 2002/0078537 | A1 * | 6/2002 | Shibuya | A47G 27/0418 24/662 |
| 2009/0151135 | A1 * | 6/2009 | Park | B60N 3/046 24/453 |
| 2011/0113600 | A1 * | 5/2011 | Hasegawa | A44B 17/0041 24/594.11 |
| 2012/0124791 | A1 * | 5/2012 | Hasegawa | A44B 17/007 24/596.1 |
| 2013/0152347 | A1 * | 6/2013 | Hasegawa | A44B 17/0052 24/681 |

* cited by examiner

SNAP BUTTON ASSEMBLY

REFERENCE TO RELATED APPLICATION

This application claims the benefit of U.S. Provisional Patent Application No. 62/849,436, filed on May 17, 2019 and entitled PROTECTOR WASHER, the content of which is hereby incorporated by reference in its entirety.

FIELD OF THE INVENTION

This application relates to a snap buttons, and, more particularly, to washers that can be assembled with snap buttons.

BACKGROUND

Snap buttons are used on a variety of items such as clothing, bags, covers, etc. Snap buttons are also used to attach a trim cover, such as a floor mat or the like, to a particular location, such as a location in a vehicle. A snap button typically consists of two components, a socket assembly and a stud assembly, that are provided on various or components or items to be selectively connected and disconnected via the snap button. The socket assembly of the snap button may have a receiving area that also includes an engagement member (such as an annular spring) incorporated into the receiving area. The stud assembly of the snap button includes a protrusion that may be at least partially inserted into the receiving area of the socket assembly and into engagement with the engagement member to connect the stud assembly to the socket assembly.

With existing snap buttons, debris or other material may enter and become trapped in the socket assembly and/or the stud assembly. Such debris cannot be easily removed from the snap button and may interfere with the engagement between the socket assembly and the stud assembly. The socket assembly and/or the stud assembly of existing snap buttons are also commonly exposed on whatever item or component that they are installed on, making the components of the snap button more prone to damage.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to certain embodiments, a protector washer includes a base defining a center aperture, a side wall defining at least one slit, and a snap segment configured to engage a snap button. In some examples, the snap segment is on the side wall. In various examples, the snap segment is on the base between the center aperture and the side wall.

According to various embodiments, a snap button assembly includes a snap button and a protector washer. The protector washer includes a base and a side wall defining a receiving area and at least one slit, and the snap button is at least partially positioned within the receiving area.

According to some embodiments, a protector washer includes a base, a side wall, and a snap segment. The base defines a securing aperture, and the side wall extends from the base and defines at least one slit extending through a thickness of the side wall. The snap segment is configured to engage a snap button component.

In various aspects, the snap segment is on the side wall. In some examples, the base includes a perimeter edge, a height of a portion of the side wall proximate to the perimeter edge is less than a height of a radially inward portion of the side wall that is radially inward from the perimeter edge, and the snap segment is on the radially inward portion of the side wall.

In certain aspects, the side wall defines a receiving area, and the at least one slit is in fluid communication with the receiving area. In various examples, the snap segment is on the base and between the side wall and the securing aperture. In some cases, the base defines at least one pocket on a side of the base opposite from the side wall. The protector washer may further include at least one leg on a side of the base opposite from the side wall. In some embodiments, the base includes a perimeter edge, and a height of a portion of the side wall proximate to the perimeter edge is less than a height of a radially inward portion of the side wall that is radially inward from the perimeter edge.

In various examples, the snap segment is a first snap segment of a plurality of snap segments and wherein the slit is a first slit of a plurality of slits. In certain embodiments, the snap segment includes a rib portion. The base may further define at least one snap aperture, and the at least one snap aperture is proximate to the snap segment.

According to various embodiments, a snap button assembly includes a snap button component and a protector washer that includes a base and a side wall defining a receiving area and at least one slit extending through a thickness of the side wall. The snap button component may be at least partially positioned within the receiving area.

In some examples, the snap button component includes a socket assembly, the protector washer includes a snap segment on the side wall, and the snap segment is engaged with the socket assembly at least partially positioned within the receiving area. In various examples, the snap button component includes a stud assembly, the protector washer includes a snap segment within the receiving area and on the base, on the side wall, and the snap segment is engaged with the stud assembly at least partially positioned within the receiving area. In certain examples, the base includes a perimeter edge, and a height of a portion of the side wall proximate to the perimeter edge is less than a height of a radially inward portion of the side wall that is radially inward from the perimeter edge. The protector washer may include a snap segment configured to engage the snap button component, and the snap segment may be on at least one of the side wall or the base within the receiving area.

According to certain embodiments, a protector washer includes a base, a side wall extending from the base, and a snap segment configured to engage a snap button component. The side wall defines a receiving area and at least one slit extending through a thickness of the side wall and in fluid communication with the receiving area.

In some cases, the snap segment is on the side wall or the snap segment is on the base and within the receiving area. The base may include a securing aperture, and the snap segment may be within the receiving area between the securing aperture and the side wall. In various examples, the base defines at least one pocket on a side of the base opposite from the side wall.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "down," "top," "bottom," "left," "right," "front," and "back," among others, are intended to refer to the orientation as illustrated and described in the figure (or figures) to which the components and directions are referencing.

Described herein are protector washers for snap buttons as well as snap buttons that include such protector washers. In certain aspects, the protector washer can be assembled with a socket assembly and/or a stud assembly of a snap button. The protector washer assembled with the socket assembly and/or the stud assembly may allow for debris or other material to be removed from the snap button without affecting the engagement or snap function of the snap button. The protector washer assembled with the socket assembly and/or the stud assembly may also protect the socket assembly and/or the stud assembly when the snap button is installed on various or components or items including, but not limited to, trim covers.

Figure 1:
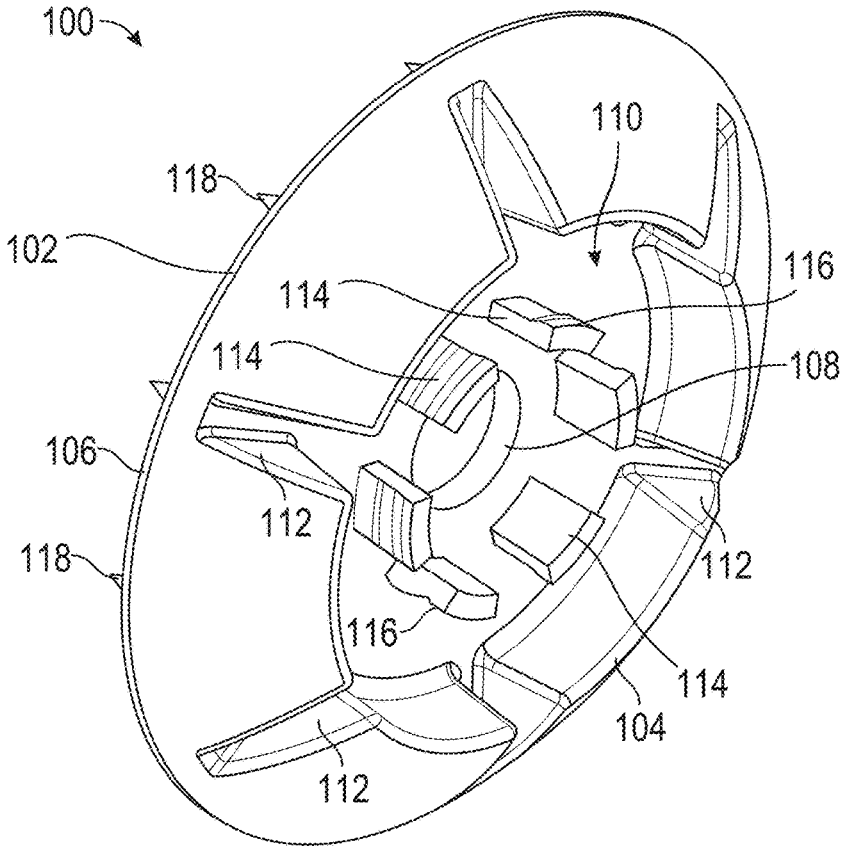
FIG. 1 is a top perspective view of a protector washer for a snap button according to embodiments of the disclosure.
Figure 2:
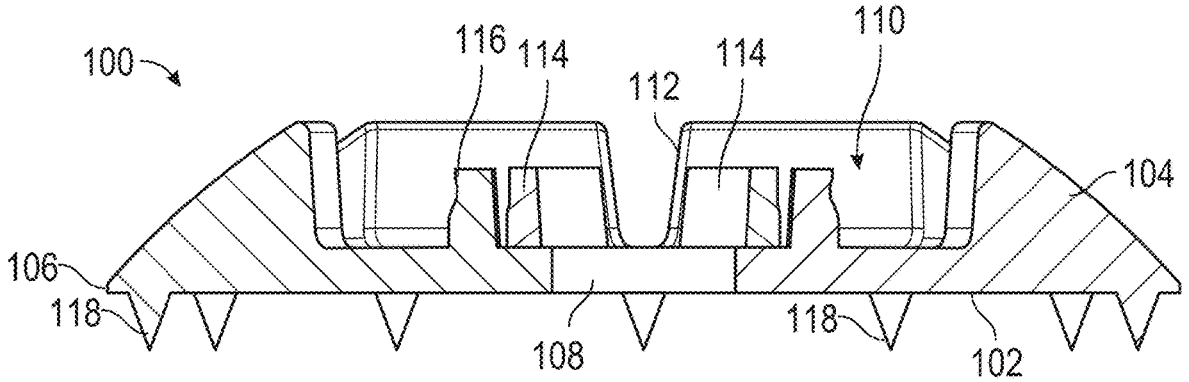
FIG. 2 is a sectional view of the protector washer of FIG. 1.
Figure 3:
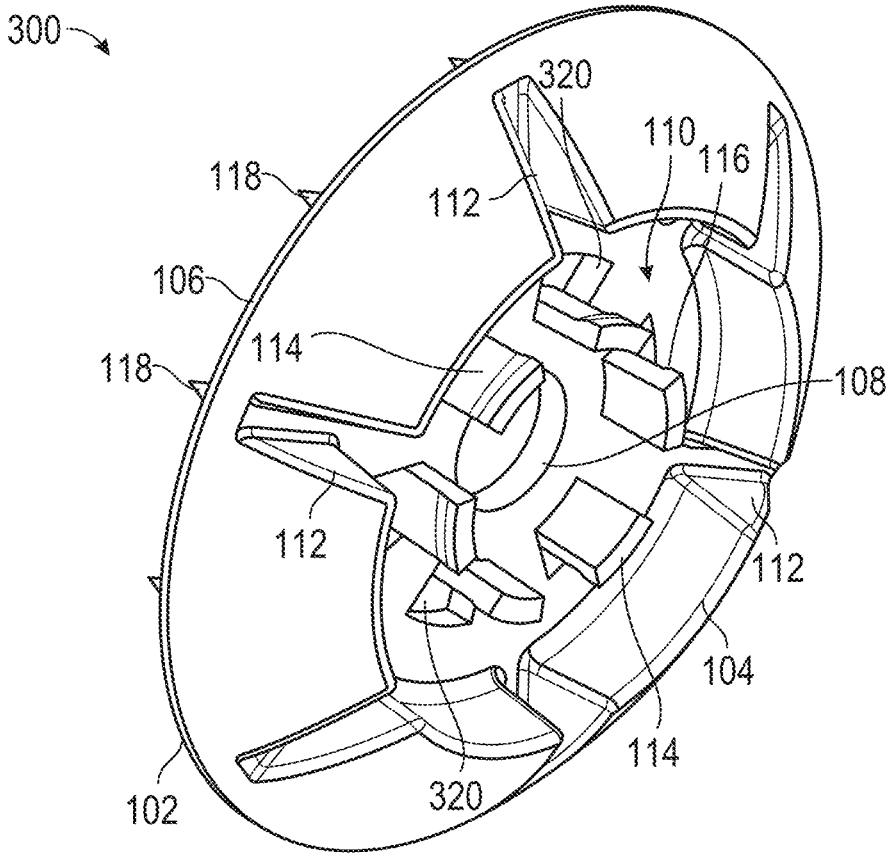
FIG. 3 is a top perspective view of a protector washer for a snap button according to embodiments of the disclosure.
Figure 4:
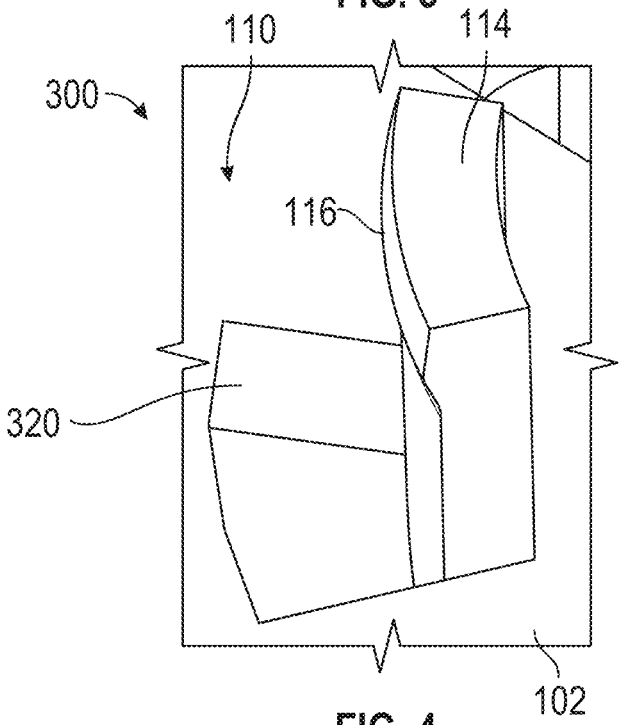
FIG. 4 is a perspective view of a portion of the protector washer of FIG. 3.
Figure 5:
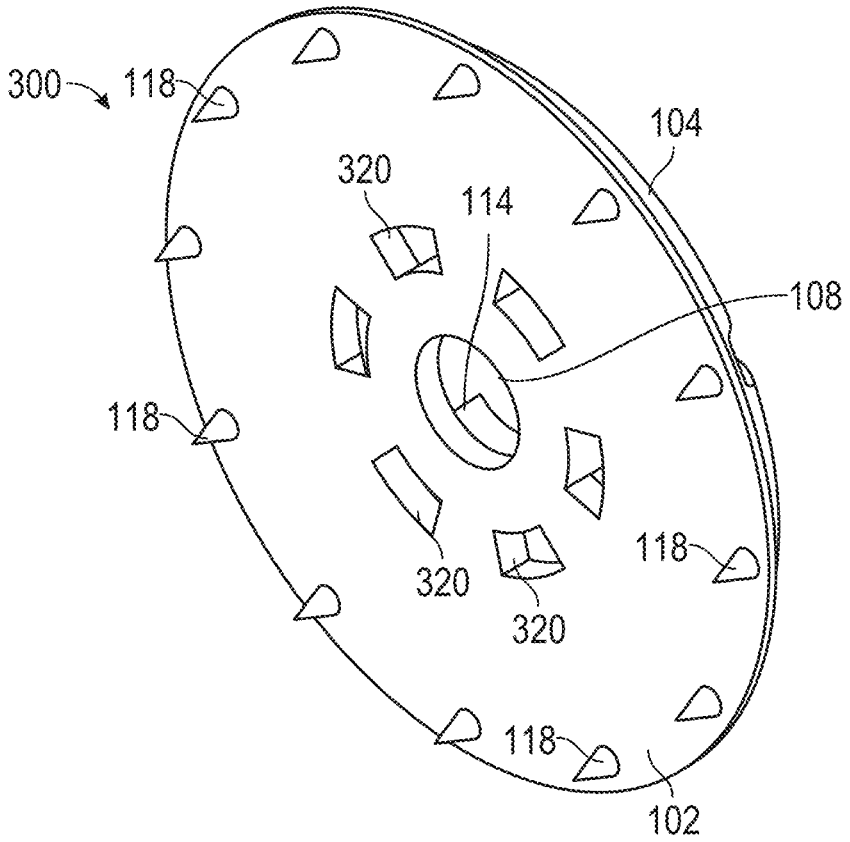
FIG. 5 is a bottom perspective view of the protector washer of FIG. 3.
Figure 6:
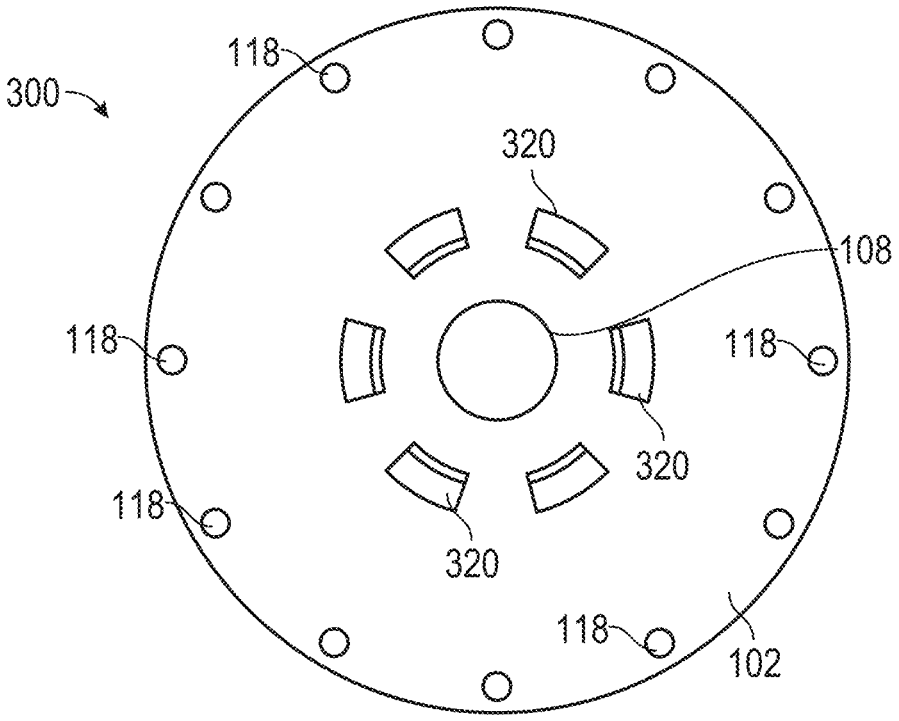
FIG. 6 is a bottom view of the protector washer of FIG. 3.

FIGS. 1 and 2 illustrate an example of a protector washer 100 according to various embodiments. As discussed in detail below with reference to FIGS. 13-17, the protector washer 100 may be assembled with a socket assembly or a stud assembly of a snap button (both of which are generally referred to herein as a "snap button component", with it being understood that a socket assembly is a complimentary snap button component to the stud assembly and vice versa). In various aspects, the protector washer 100 may be constructed from various suitable materials or combinations of materials as desired, including, but not limited to, various metals, plastics, or composites. In certain aspects, the protector washer 100 may be a hard plastic (including but not limited to polyoxymethylene or POM). In various aspects, the protector washer 100 formed from a hard plastic may be hard enough to not deform during assembly while enabling assembly of the snap button such that the protector washer 100 stays attached with the snap button. In some optional examples, the material used to form the protector washer 100 does not need a high dimensional tolerance. The protector washer 100 may be formed from such materials into the protector washer 100 by various suitable forming methods as desired. In one non-limiting example, the protector washer 100 may be formed by molding polyoxymethylene.

The protector washer 100 includes a base 102 and a side wall 104 extending from the base 102. In the example of FIGS. 1 and 2, the base 102 has a perimeter edge 106 that forms a generally circular shape. However, the shape of the base 102 should not be considered limiting, as in other examples, the perimeter edge 106 of the base 102 may have other shapes as desired, including, but not limited to, triangular shapes, elliptical shapes, rectangular shapes, etc. In certain examples, the base 102 defines a securing aperture 108 that selectively receives a securing device or mechanism that secures the protector washer 100 and snap button component to a component or item such as the trim cover. In certain aspects, the securing aperture 108 is centered on the base 102, although it need not be in other examples.

The side wall 104 of the protector washer 100 defines a receiving area 110 that may at least partially receive the snap button component when the protector washer 100 is assembled with the snap button component. In certain cases, the side wall 104 may have a tapered shape that decreases in height in a radial direction. For example, and as best illustrated in FIG. 2, in certain examples, a portion of the side wall 104 closer to the perimeter edge 106 of the base 102 may have a height that is less than a height of a portion of the side wall 104 that is closer to the center of the base 102. However, the shape of the side wall 104 should not be considered limiting on the disclosure, and moreover the side wall 104 need not be tapered in other examples. As some non-limiting examples, in other cases, the side wall 104 may have a stepped profile, squared profile, curved profile, or other profile as desired.

The side wall 104 of the protector washer 100 may define one or more slits 112 that extends through a thickness of the side wall 104. As illustrated in FIGS. 1 and 2, the one or more slits 112 extend to (i.e., are in fluid communication with) the receiving area 110 of the protector washer 100 such that debris can be removed from the receiving area 110 through the one or more slits 112. In various examples, such as the embodiment illustrated in FIGS. 1 and 2, the side wall 104 defines a plurality of slits 112, while in other embodiments, a single slit 112 may be utilized. The shape, size, number, or pattern of slits 112 should not be considered limiting on the disclosure. For example, in some cases, a height of one or more slits 112 may be less than the height of the side wall 104 or substantially the same as the height of the side wall 104. Similarly, where a plurality of slits 112 re included, the slits 112 may be provided at regular or irregular intervals along the side wall 104. As a further example, while the slits 112 in FIGS. 1 and 2 are illustrated with squared or planar surfaces, in other examples, the slits 112 may have arcuate surfaces, angled surfaces, a saw-tooth profile, other arcuate surfaces, etc. as desired. Moreover, when a plurality of slits 112 are included, the shape or size of one slit 112 may be the same as or different from the shape or size of another slit 112.

Optionally, the protector washer 100 may also include one or more snap segments 114. In various aspects, the one or more snap segments 114 may be included to facilitate engagement between the protector washer 100 and the snap button component assembled with the protector washer 100. In some cases, the snap segments 114 may be included when the protector washer 100 is for assembly with a stud assembly of the snap button and/or may be omitted when the protector washer 100 is for assembly with a socket assembly of the snap button. However, in other examples, the snap segments 114 may be omitted when the protector washer 100 is for assembly with the stud assembly and/or may be included when the protector washer 100 is for assembly with the socket assembly. In the example of FIGS. 1 and 2, and as discussed in greater detail with respect to FIGS. 13-17, the one or more snap segments 114 are engageable with a stud assembly of the snap button.

In some examples, and as illustrated in FIGS. 1 and 2, when the one or more snap segments 114 are included, they may be provided on portions of the base 102 between the side wall 104 and the securing aperture 108. However, the location of the one or more snap segments 114 should not be considered limiting on the disclosure (see FIGS. 7-9). Similarly, while a plurality of snap segments 114, each having a generally squared profile, are illustrated in the embodiment of FIGS. 1 and 2, the number, shape, and size of the snap segments 114 should not be considered limiting on the disclosure. In certain examples, the shape, size, location, and number of snap segments 114 may be controlled depending on a desired stud assembly to be assembled with the protector washer 100. In some examples, the one or more snap segments 114 may include a rib portion 116 that facilitates engagement between the protector washer 100 and the snap button component. The profile and location of the rib portion 116 on the snap segments 114 should not be considered limiting on the disclosure. Moreover, it will be appreciated that in other examples, the rib portion 116 may be omitted and other suitable engagement features may be provided on the one or more snap segments 114 to facilitate engagement between the protector washer 100 and the snap button component.

In various embodiments, the protector washer 100 may optionally include one or more legs 118 on the base 102 opposite from the side wall 104. In other cases, the legs 118 may be omitted. When included, the one or more legs 118 may facilitate attachment and/or positioning of the protector washer 100 at a particular location on a trim cover or other item as desired. In some cases, and as illustrated in FIGS. 1 and 2, a plurality of legs 118 having a pointed profile. However, the number, shape, size, and location of the one or more legs 118 should not be considered limiting on the disclosure.

FIGS. 3-6 illustrate an example of a protector washer 300 according to various embodiments. The protector washer 300 is substantially similar to the protector washer 100 except the protector washer 300 additionally includes one or more snap apertures 320 that are defined in the base 102. In various aspects, the one or more snap apertures 320 may assist with the attachment of the protector washer to the snap button component such as the stud assembly. In some embodiments, the one or more snap apertures 320 may also simplify the mold for the protector washer 300 and thereby simply the molding process for forming the protector washer 300. The snap apertures 320 may also provide additional locations at which debris within the receiving area 110 can be removed from the receiving area 110. In some cases, the number of snap apertures 320 corresponds with the number of snap segments 114 and each snap aperture 320 is provided proximate to a corresponding snap segment 114. In the example of FIGS. 3-6, the protector washer 300 includes a plurality of snap apertures 320, each of which is provided proximate to a corresponding snap segment 114. However, the shape, size, number, and location of the snap apertures 320 should not be considered limiting on the disclosure, and the snap apertures 320 need not correspond with particular snap segments 114. In certain examples, the shape, size, location, and number of snap apertures 320 may be controlled depending on a desired stud assembly to be assembled with the protector washer 300. Similar to the protector washer 100, in various examples, the protector washer 300 is configured to engage with a stud assembly of a snap button.

Figure 7:
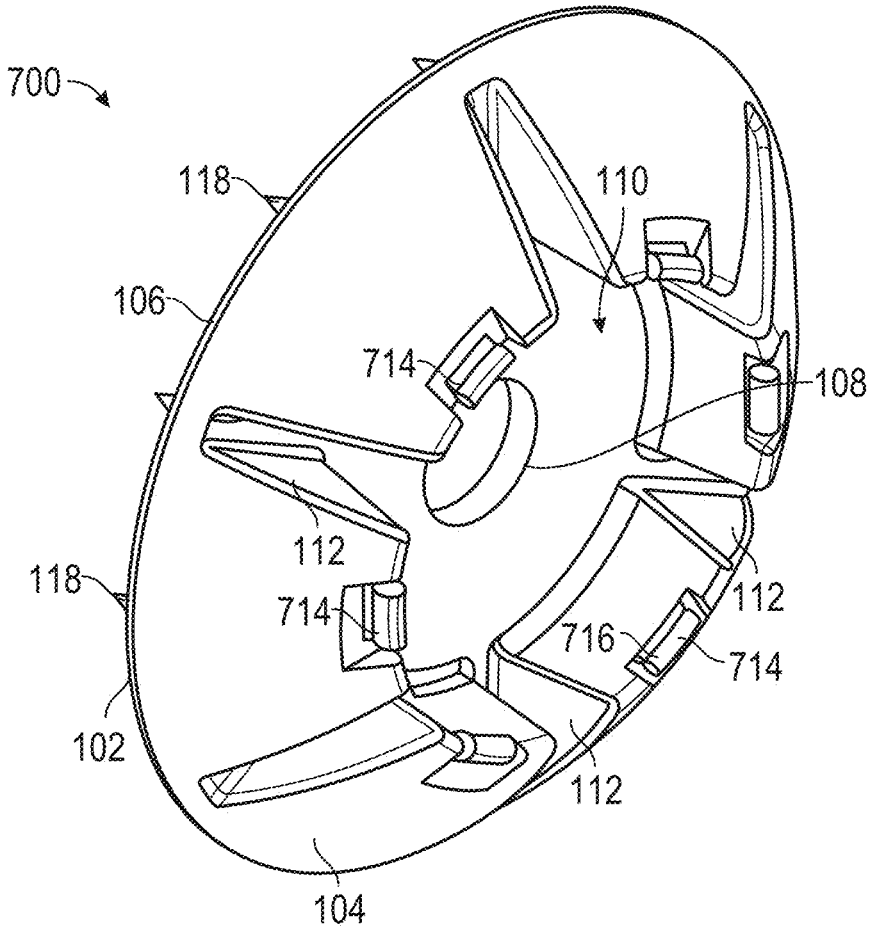
FIG. 7 is a perspective view of a protector washer for a snap button according to embodiments of the disclosure.
Figure 8:
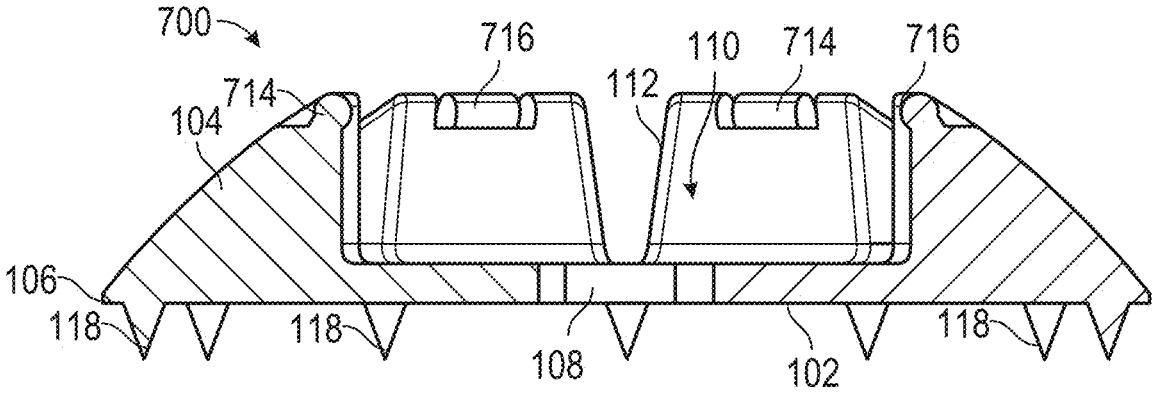
FIG. 8 is a sectional view of the protector washer of FIG. 7.
Figure 9:
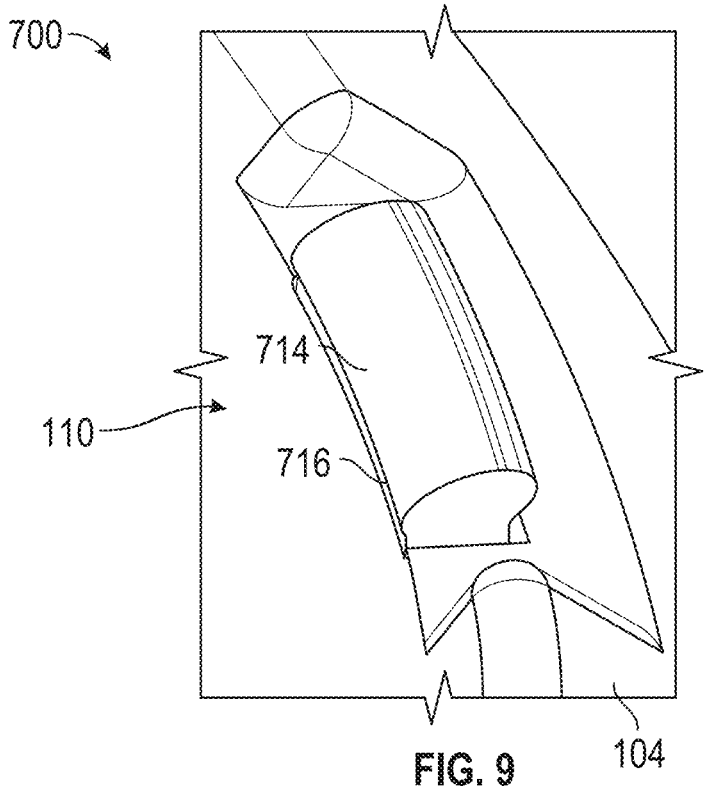
FIG. 9 is a perspective view of a portion of the protector washer of FIG. 7.

FIGS. 7-9 illustrate another example of a protector washer 700 according to various embodiments. The protector washer 700 is substantially similar to the protector washer 100 except that one or more snap segments 714 of the protector washer 700 are provided on the side wall 104 rather than between the side wall 104 and the securing aperture 108 as in the protector washer 100. In some cases, the one or more snap segments 714 may be provided proximate to or at a tallest portion of the side wall 104, although they need not be in other examples. In some examples, the snap segments 714 may be centered on the side wall 104 between a pair of adjacent slits 112, although they need not be in other examples. Similar to the snap segments 114, each of the one or more snap segments 714 may include a rib portion 716 to facilitate engagement between the protector washer 700 and the snap button component. The number, shape, size, pattern, and location of the snap segments 714 should not be considered limiting on the disclosure.

Figure 10:
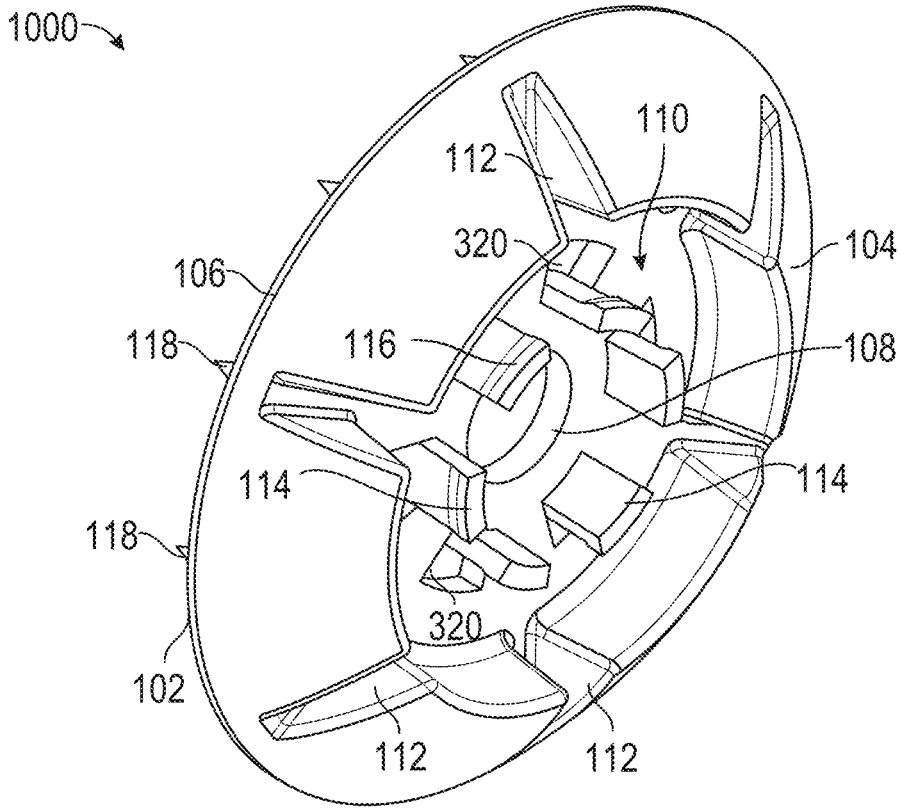
FIG. 10 is a top perspective view of a protector washer for a snap button according to embodiments of the disclosure.
Figure 11:
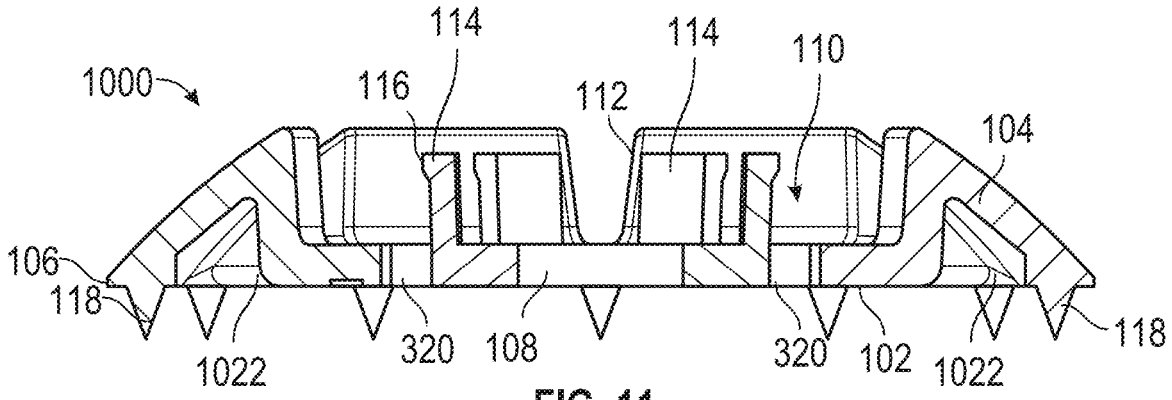
FIG. 11 is a sectional view of the protector washer of FIG. 10.
Figure 12:
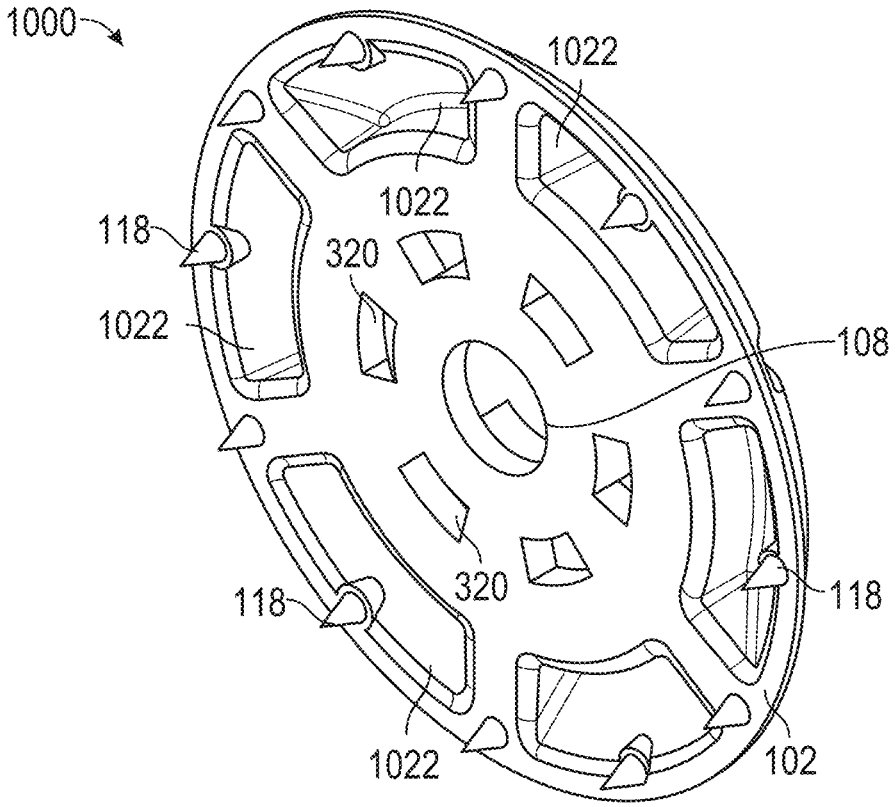
FIG. 12 is a bottom perspective view of the protector washer of FIG. 10.

FIGS. 10-12 illustrate another example of a protector washer 1000 according to various embodiments. The protector washer 1000 is substantially similar to the protector washer 300 and includes the snap apertures 320. Compared to the protector washer 300, the protector washer 1000 defines one or more pockets 1022 with openings provided on the side of the base 102 opposite from the side walls 104. The number, shape, size, or location of the pockets 1022 should not be considered limiting on the disclosure. In various aspects, the side wall 104 may at least partially define one or more of the pockets 1022. When included, the one or more pockets 1022 may minimize or reduce shrinkage of portions of the protector washer 1000 during a forming process that may otherwise occur when the protector washer 1000 has portions with different thicknesses. The one or more pockets 1022 may also reduce the amount of material needed to form the protector washer 1000, thereby reducing costs associated with producing the protector washer 1000. In various aspects, the one or more pockets 1022 may also impart greater flexibility on the protector washer 1000 when the protector washer 1000 is assembled with the snap button component and/or when the protector washer 1000 is provided on an item such as the trim cover.

In some non-limiting examples, the protector washer 100, the protector washer 300, and the protector washer 1000 may each be engageable with the stud assembly of the snap button, and the protector washer 700 may be engageable with the socket assembly of the snap button.

Figure 13:
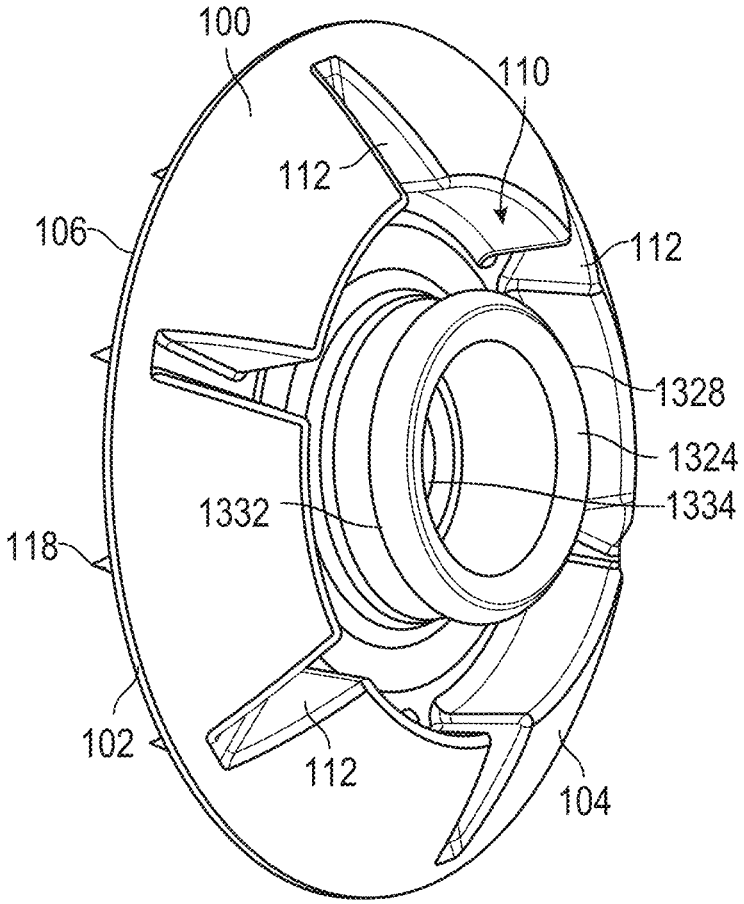
FIG. 13 is a perspective view of the protector washer of FIG. 1 assembled with a stud assembly of a snap button according to embodiments of the disclosure.
Figure 14:
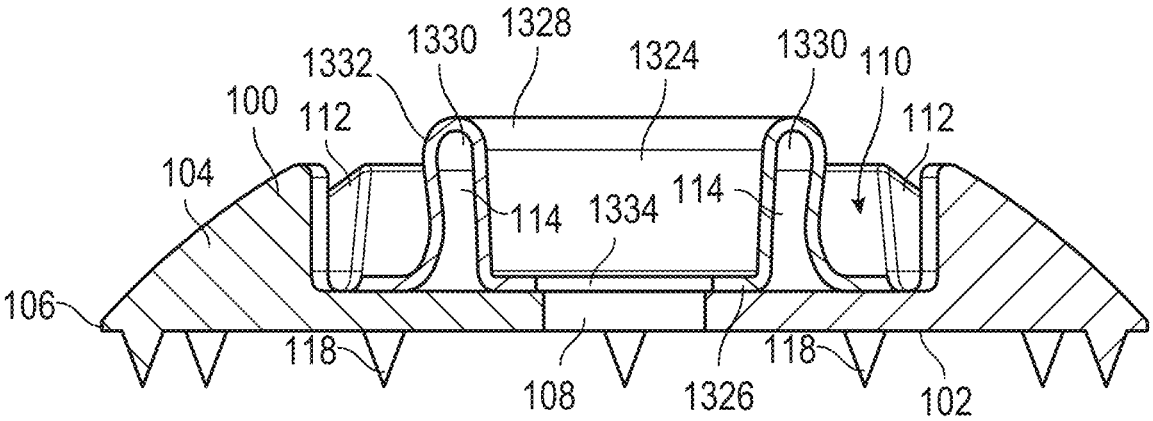
FIG. 14 is a sectional view of the assembled protector washer and stud assembly of FIG. 13.

FIGS. 13 and 14 illustrate the protector washer 100 assembled with a stud assembly 1324 of a snap button that is configured to engage a corresponding socket assembly (not shown). The stud assembly 1324 may be constructed from various materials which can be assembled with the protector washer 100. In some non-limiting examples, the stud assembly 1324 may be constructed from a metal, which may include, but is not limited to, stainless steel, steel, brass, zinc, and/or aluminum. Various other materials may be utilized for the stud assembly 1324 as desired. As illustrated in FIGS. 13 and 14, in some examples, the stud assembly 1324 includes a base 1326 and a protrusion 1328 extending from the base 1326 and that includes an engagement portion 1332. In some cases, an engagement portion 1332 of the protrusion 1328 may have a diameter that is greater than a diameter of a portion of the protrusion proximate to the base 1326 to facilitate engagement with a corresponding socket assembly. In various aspects, the protrusion 1328 defines a receiving area 1330. It will be appreciated that the particular stud assembly 1324 is provided for reference purposes only and should not be considered limiting on the disclosure and is provided for reference purposes only, and the protector washers described herein may be assembled with any stud assembly of a snap button as desired.

As best illustrated in FIG. 14, when the protector washer 100 is assembled with the stud assembly 1324, the snap segments 114 may be at least partially positioned within the receiving area 1330 of the protrusion 1328. Optionally, the rib portion of the snap segments 114 may engage the engagement portion 1332 of the protrusion 1328 within the receiving area 1330 to facilitate engagement between the protector washer 100 and the stud assembly 1324 and to position the stud assembly 1324 within the receiving area 110 of the protector washer 100. As best illustrated in FIG. 14, the base 1326 of the stud assembly 1324 may define a securing aperture 1334. In various examples, when the protector washer 100 is assembled with the stud assembly 1324, the securing aperture 1334 of the stud assembly 1324 may be substantially aligned with the securing aperture 108 of the protector washer 100.

Figure 15:
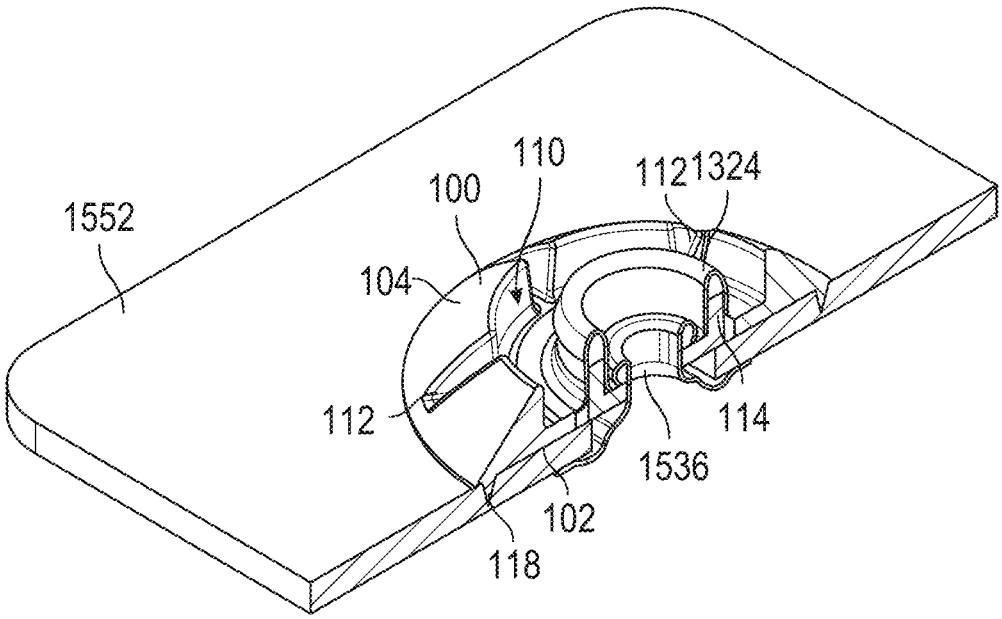
FIG. 15 illustrates the assembled protector washer and stud assembly of FIG. 13 secured to a trim cover with a rivet according to embodiments of the disclosure.
Figure 16:
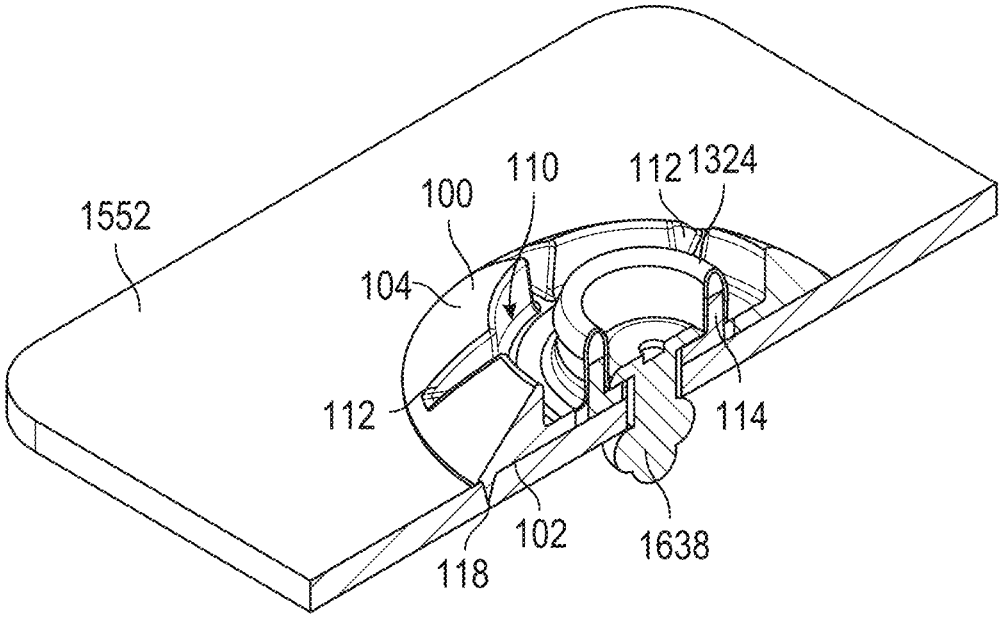
FIG. 16 illustrates the assembled protector washer and stud assembly of FIG. 13 secured to a trim cover with a post according to embodiments of the disclosure.
Figure 17:
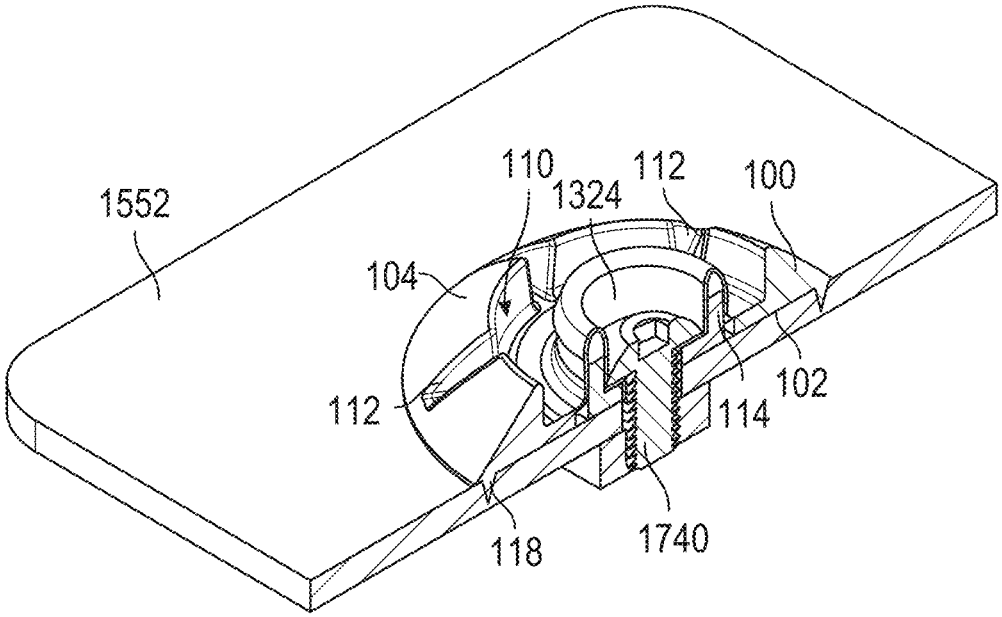
FIG. 17 illustrates the assembled protector washer and stud assembly of FIG. 13 secured to a trim cover with a screw according to embodiments of the disclosure.

Referring to FIGS. 15-17, various securing devices or mechanisms may be at least partially inserted through the aligned securing apertures 108, 1334 to secured the assembled protector washer 100 and stud assembly 1324 on a trim cover 1552 (or other component or item as desired). In FIG. 15 the securing device is a rivet 1536, in FIG. 16 the securing device is a post 1638, and in FIG. 17 the securing device is a screw 1740. Various other suitable securing devices may be utilized as desired. In some cases, the securing device is installed in a pre-punched aperture in the trim cover 1552. In such examples, the protector washer 100 may cover the pre-punched aperture to improve the appearance and to provide protection to the portion of the trim cover 1552 surrounding the pre-punched aperture. The protector washer 100 also adds protection to the stud assembly 1324 to minimize or prevent potential damage.

As illustrated in FIGS. 15-17, when included, the legs 118 of the protector washer 100 may at least partially penetrate (or otherwise engage) the trim cover 1552 to further secure and/or position the assembled protector washer 100 and stud assembly 1324 relative to the trim cover 1552.

Figure 18:
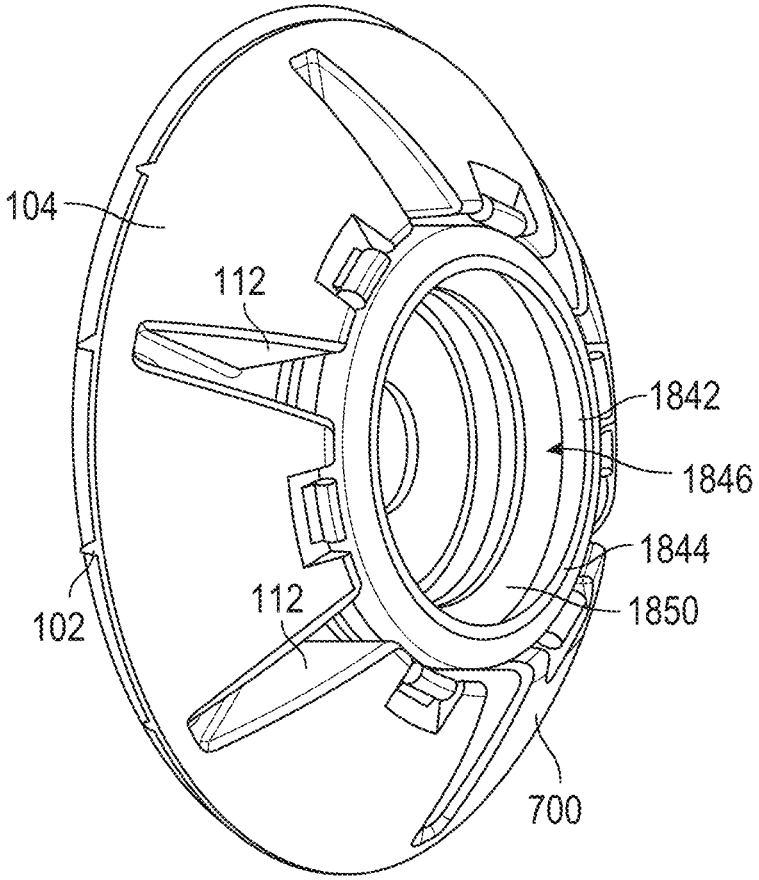
FIG. 18 is a perspective view of the protector washer of FIG. 7 assembled with a socket assembly of a snap button according to embodiments of the disclosure.
Figure 19:
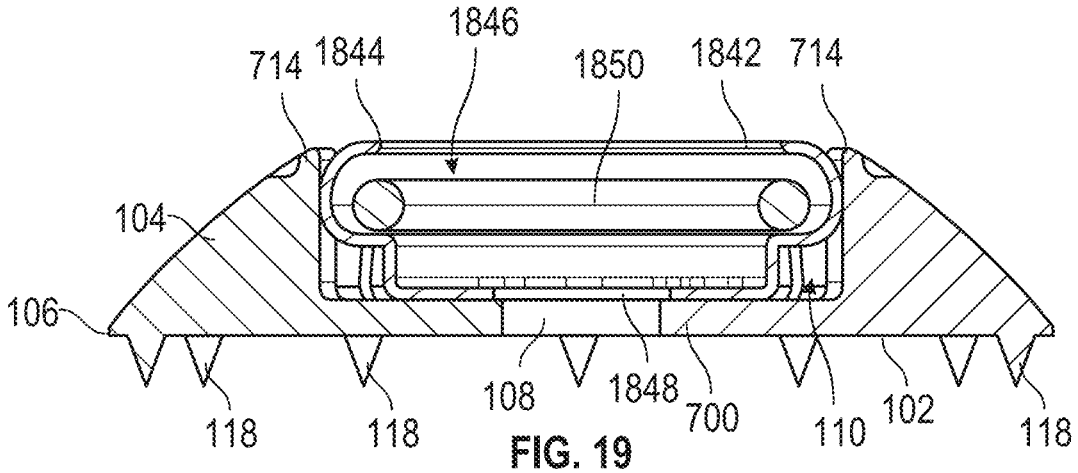
FIG. 19 is a sectional view of the assembled protector washer and socket assembly of FIG. 18.

FIGS. 18 and 19 illustrate the protector washer 700 assembled with a socket assembly 1842 of a snap button that is configured to engage a corresponding stud assembly (not shown). The socket assembly 1842 may be constructed from various materials which can be assembled with the protector washer 100. In some non-limiting examples, the socket assembly 1842 may be constructed from a metal, which may include, but is not limited to, stainless steel, steel, brass, zinc, and/or aluminum. Various other materials may be utilized for the socket assembly 1842 as desired. The socket assembly 1842 includes a cage 1844 that defines a receiving area 1846, and an engagement member such as an annular spring 1850 is incorporated into the receiving area 1846. It will be appreciated that the particular stud assembly 1324 is provided for reference purposes only and should not be considered limiting on the disclosure and is provided for reference purposes only, and the protector washers described herein may be assembled with any socket assembly of a snap button as desired.

As best illustrated in FIG. 19, when the protector washer 700 is assembled with the socket assembly 1842, the snap segments 714 may at least partially engage the cage 1844 to facilitate engagement and positioning of the socket assembly 1842 within the receiving area 110 of the protector washer 700. As best illustrated in FIG. 19, the cage 1844 of the socket assembly 1842 may define a securing aperture 1848. In various examples, when the protector washer 700 is assembled with the socket assembly 1842, the securing aperture 1848 of the socket assembly 1842 may be substantially aligned with the securing aperture 108 of the protector washer 700. Securing devices including but not limited to the rivet 1536, the post 1638, and/or the screw 1740 may be at least partially inserted through the aligned apertures 108, 1848 to secure and position the assembled protector washer

700 and socket assembly 1842 relative to an item such as the trim cover 1552 (or other component or item as desired).

A collection of exemplary embodiments, including at least some explicitly enumerated as "Illustrations," providing additional description of a variety of embodiment types in accordance with the concepts described herein are provided below. These illustrations are not meant to be mutually exclusive, exhaustive, or restrictive; and the invention is not limited to these illustrations but rather encompasses all possible modifications and variations within the scope of the issued claims and their equivalents.

Illustration 1. A protector washer comprising: a base defining a center aperture; a side wall defining at least one slit; and a snap segment configured to engage a snap button.

Illustration 2. The protector washer of any preceding or subsequent illustrations or combination of illustrations, wherein the snap segment is on the side wall.

Illustration 3. The protector washer of any preceding or subsequent illustrations or combination of illustrations, wherein the snap segment is on the base between the center aperture and the side wall.

Illustration 4. A snap button assembly comprising: a snap button; and a protector washer comprising: a base; a side wall defining a receiving area and at least one slit, wherein the snap button is at least partially positioned within the receiving area.

Illustration 5. A protector washer comprising: a base defining a securing aperture; a side wall extending from the base and defining at least one slit extending through a thickness of the side wall; and a snap segment configured to engage a snap button component.

Illustration 6. The protector washer of any preceding or subsequent illustrations or combination of illustrations, wherein the snap segment is on the side wall.

Illustration 7. The protector washer of any preceding or subsequent illustrations or combination of illustrations, wherein the base comprises a perimeter edge, wherein a height of a portion of the side wall proximate to the perimeter edge is less than a height of a radially inward portion of the side wall that is radially inward from the perimeter edge, and wherein the snap segment is on the radially inward portion of the side wall.

Illustration 8. The protector washer of any preceding or subsequent illustrations or combination of illustrations, wherein the side wall further defines a receiving area, and wherein the at least one slit is in fluid communication with the receiving area.

Illustration 9. The protector washer of any preceding or subsequent illustrations or combination of illustrations, wherein the snap segment is on the base and between the side wall and the securing aperture.

Illustration 10. The protector washer of any preceding or subsequent illustrations or combination of illustrations, wherein the base defines at least one pocket on a side of the base opposite from the side wall.

Illustration 11. The protector washer of any preceding or subsequent illustrations or combination of illustrations, further comprising at least one leg on a side of the base opposite from the side wall.

Illustration 12. The protector washer of any preceding or subsequent illustrations or combination of illustrations, wherein the base comprises a perimeter edge, and wherein a height of a portion of the side wall proximate to the perimeter edge is less than a height of a radially inward portion of the side wall that is radially inward from the perimeter edge.

Illustration 13. The protector washer of any preceding or subsequent illustrations or combination of illustrations, wherein the snap segment is a first snap segment of a plurality of snap segments and wherein the slit is a first slit of a plurality of slits.

Illustration 14. The protector washer of any preceding or subsequent illustrations or combination of illustrations, wherein the snap segment comprises a rib portion.

Illustration 15. The protector washer of any preceding or subsequent illustrations or combination of illustrations, wherein the base further defines at least one snap aperture, and wherein the at least one snap aperture is proximate to the snap segment.

Illustration 16. A snap button assembly comprising: a snap button component; and a protector washer comprising: a base; and a side wall defining a receiving area and at least one slit extending through a thickness of the side wall, wherein the snap button component is at least partially positioned within the receiving area.

Illustration 17. The snap button assembly of any preceding or subsequent illustrations or combination of illustrations, wherein the snap button component comprises a socket assembly, wherein the protector washer further comprises a snap segment on the side wall, and wherein the snap segment is engaged with the socket assembly at least partially positioned within the receiving area.

Illustration 18. The snap button assembly of any preceding or subsequent illustrations or combination of illustrations, wherein the snap button component comprises a stud assembly, wherein the protector washer further comprises a snap segment within the receiving area and on the base, on the side wall, and wherein the snap segment is engaged with the stud assembly at least partially positioned within the receiving area.

Illustration 19. The snap button assembly of any preceding or subsequent illustrations or combination of illustrations, wherein the base comprises a perimeter edge, and wherein a height of a portion of the side wall proximate to the perimeter edge is less than a height of a radially inward portion of the side wall that is radially inward from the perimeter edge.

Illustration 20. The snap button assembly of any preceding or subsequent illustrations or combination of illustrations, wherein the protector washer further comprises a snap segment configured to engage the snap button component, and wherein the snap segment is on at least one of the side wall or the base within the receiving area.

Illustration 21. A protector washer comprising: a base; a side wall extending from the base and defining: a receiving area; and at least one slit extending through a thickness of the side wall and in fluid communication with the receiving area; and a snap segment configured to engage a snap button component.

Illustration 22. The protector washer of any preceding or subsequent illustrations or combination of illustrations, wherein the snap segment is on the side wall.

Illustration 23. The protector washer of any preceding or subsequent illustrations or combination of illustrations, wherein the snap segment is on the base and within the receiving area.

Illustration 24. The protector washer of any preceding or subsequent illustrations or combination of illustrations, wherein the base further comprises a securing aperture, and wherein the snap segment is within the receiving area between the securing aperture and the side wall.

Illustration 25. The protector washer of any preceding or subsequent illustrations or combination of illustrations, wherein the base defines at least one pocket on a side of the base opposite from the side wall.

The above-described aspects are merely possible examples of implementations, merely set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described invention, nor the claims that follow.

That which is claimed:

1. A snap button assembly comprising:

a snap button component, wherein the snap button component is configured to selectively engage a complimentary snap button component;

a protector washer comprising:

a base;

a side wall extending from the base and defining at least one slit extending through a thickness of the side wall; and a snap segment configured to engage the snap button component; and a securing device, wherein the securing device secures the protector washer engaged with the snap button component, wherein the base defines a securing aperture, and wherein the snap segment is on the base and between the side wall and the securing aperture.

2. The snap button assembly of claim 1, wherein the snap segment is on the side wall.

3. The snap button assembly of claim 1, wherein the side wall further defines a receiving area, and wherein the at least one slit is in fluid communication with the receiving area.

4. The snap button assembly of claim 1, wherein the base defines at least one pocket on a side of the base opposite from the side wall.

5. The snap button assembly of claim 1, further comprising at least one leg on a side of the base opposite from the side wall.

6. The snap button assembly of claim 1, wherein the base comprises a perimeter edge, and wherein a height of a portion of the side wall proximate to the perimeter edge is less than a height of a radially inward portion of the side wall that is radially inward from the perimeter edge.

7. The snap button assembly of claim 1, wherein the snap segment is a first snap segment of a plurality of snap segments and wherein the slit is a first slit of a plurality of slits.

8. The snap button assembly of claim 1, wherein the snap segment comprises a rib portion.

9. The snap button assembly of claim 1, wherein the snap aperture is proximate to the snap segment.

10. A snap button assembly comprising:

a male snap button component;

a female snap button component configured to selectively engage the male snap button component; and a protector washer comprising:

a base; and a side wall defining a receiving area and at least one slit extending through a thickness of the side wall, wherein the male snap button component or the female snap button component is at least partially positioned within the receiving area, wherein the base comprises a perimeter edge, and wherein a height of a portion of the side wall proximate to the perimeter edge is less than a height of a radially inward portion of the side wall that is radially inward from the perimeter edge.

11. The snap button assembly of claim 10, wherein the female snap button component is at least partially positioned in the receiving area, wherein the female snap button component comprises a socket assembly, wherein the protector washer further comprises a snap segment on the side wall, and wherein the snap segment is engaged with the socket assembly at least partially positioned within the receiving area.

12. The snap button assembly of claim 10, wherein the male snap button component is at least partially positioned within the receiving area, wherein the male snap button component comprises a stud assembly, wherein the protector washer further comprises a snap segment within the receiving area and on the base, and wherein the snap segment is engaged with the stud assembly at least partially positioned within the receiving area.

13. The snap button assembly of claim 10, wherein the protector washer further comprises a snap segment configured to engage the male snap button component or the female snap button component, and wherein the snap segment is on at least one of the side wall or the base within the receiving area.

14. The snap button assembly of claim 1, wherein the base further comprises a securing aperture, wherein the snap segment is within the receiving area between the securing aperture and the side wall, and wherein the securing device extends through the securing aperture.

15. The snap button assembly of claim 1, wherein the snap button component is a male snap button component, wherein the snap button assembly further comprises the complimentary snap button component, and wherein the complimentary snap button component is a female snap button component.

16. The snap button assembly of claim 1, wherein the snap button component is a female snap button component, wherein the snap button assembly further comprises the complimentary snap button component, and wherein the complimentary snap button component is a male snap button component.

17. The snap button assembly of claim 1, wherein the securing device is configured to secure the snap button component and the protector washer to an article.

18. The snap button assembly of claim 1, wherein the securing device extends into the receiving area and overlaps a portion of the base of the protector washer within the receiving area.

19. A snap button assembly comprising:

a snap button component, wherein the snap button component is configured to selectively engage a complimentary snap button component;

a protector washer comprising:

a base;

a side wall extending from the base and defining at least one slit extending through a thickness of the side wall; and a snap segment configured to engage the snap button component; and a securing device, wherein the securing device secures the protector washer engaged with the snap button component, wherein the base comprises a perimeter edge, and wherein a height of a portion of the side wall proximate to the perimeter edge is less than a height of a radially inward portion of the side wall that is radially inward from the perimeter edge.

* * * * *